US011421190B2

(12) United States Patent
Chen et al.

(10) Patent No.: US 11,421,190 B2
(45) **Date of Patent: *Aug. 23, 2022**

(54) DETERGENT ADDITIVE

(71) Applicant: Dow Global Technologies LLC, Midland, MI (US)

(72) Inventors: Liang Chen, Sewickley, PA (US); Xue Chen, Manvel, TX (US)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 32 days.

This patent is subject to a terminal disclaimer.

(21) Appl. No.: 16/630,870

(22) PCT Filed: Jul. 10, 2018

(86) PCT No.: PCT/US2018/041375

§ 371 (c)(1),
(2) Date: Jan. 14, 2020

(87) PCT Pub. No.: WO2019/027635

PCT Pub. Date: Feb. 7, 2019

(65) Prior Publication Data

US 2020/0148976 A1 May 14, 2020

Related U.S. Application Data

(60) Provisional application No. 62/539,173, filed on Jul. 31, 2017.

(51) Int. Cl.

| | |
|---|---|
| ***C11D 3/39*** | (2006.01) |
| ***C11D 17/00*** | (2006.01) |
| ***C11D 11/02*** | (2006.01) |
| ***C11D 3/37*** | (2006.01) |
| ***C11D 7/32*** | (2006.01) |

(52) U.S. Cl.
CPC ..... *C11D 3/3935* (2013.01); *C11D 3/3753* (2013.01); *C11D 7/3263* (2013.01); *C11D 11/02* (2013.01); *C11D 17/0039* (2013.01)

(58) Field of Classification Search
CPC ..... C11D 3/39; C11D 17/00; C11D 11/02; C11D 7/32; C11D 3/37
See application file for complete search history.

(56) References Cited

U.S. PATENT DOCUMENTS 3,153,009 A * 10/1964 Rombach ..... C08J 5/18 525/61
4,203,857 A * 5/1980 Dugan ..... C11D 17/049 15/104.93
4,696,971 A * 9/1987 Degeilh ..... B32B 17/10761 525/61
6,080,710 A * 6/2000 Withenshaw ..... C11D 3/3917 252/186.25
2003/0113514 A1* 6/2003 Saito ..... C09D 129/04 428/195.1
2004/0072716 A1* 4/2004 Kistenmacher ..... C11D 3/3932 510/475
2004/0102346 A1* 5/2004 Carr ..... C11D 1/143 510/276
2007/0111921 A1* 5/2007 Artiga Gonzalez ... C11D 3/505 510/446
2007/0196629 A1* 8/2007 Smith ..... B41M 5/5254 428/195.1
2009/0156454 A1* 6/2009 Schmiedel ..... C11D 3/38672 510/302
2010/0234262 A1* 9/2010 Smith ..... C11D 11/0023 510/161
2010/0234265 A1* 9/2010 Weber ..... C11D 1/72 510/230
2014/0100152 A1 4/2014 Heppert
2016/0376353 A1* 12/2016 Puro ..... C07K 16/18 424/133.1
2016/0376535 A1* 12/2016 Chieffi ..... C11D 1/12 510/276
2018/0251710 A1* 9/2018 Pijnenburg ..... C11D 3/36
2018/0265826 A1* 9/2018 Song ..... C11D 3/3765
2020/0148810 A1* 5/2020 Zhao ..... C08G 18/0866
2020/0148976 A1* 5/2020 Chen ..... C11D 11/02
2020/0165545 A1* 5/2020 Chen ..... C11D 7/3263

FOREIGN PATENT DOCUMENTS

| | | | | |
|---|---|---|---|---|
| CA | 2233622 | | 4/1997 | |
| CA | 2233622 | A1 * | 4/1997 | ..... C11D 3/3945 |
| EP | 468824 | | 1/1992 | |
| EP | 1723222 | | 11/2006 | |
| EP | 2380210 | A1 * | 10/2011 | ..... H01L 31/048 |
| WO | 1998016621 | | 4/1998 | |
| WO | 2005087908 | | 9/2005 | |
| WO | 2017040501 | | 3/2017 | |

OTHER PUBLICATIONS

Hand Book of Thermoplastics. 20215/12/22., (Year: 2015).*
PCT/US2018/041375, Search Report and Written Opinion dated Oct. 1, 2018.
PCT/US2018/041375, International Preliminary Report on Patentability with a issuance date of Feb. 4, 2020.

* cited by examiner

*Primary Examiner* — Nicole M. Buie-Hatcher
*Assistant Examiner* — M. Reza Asdjodi

(57) ABSTRACT

A detergent additive comprising an active, the active comprising one or both of tetraacetylethylenediamine and triacetylethylenediamine; and polyvinyl butyral. A method of preparing a detergent additive comprising providing a solvent to a reaction mixture; providing polyvinyl butyral to the reaction mixture; providing an active to the reaction mixture, the active comprising one or both of tetraacetylethylenediamine and triacetylethylenediamine; mixing the reaction mixture; and spray-drying the reaction mixture.

3 Claims, No Drawings

DETERGENT ADDITIVE

BACKGROUND

Textiles, such as wearable fabrics, are typically washed by contacting the textiles with a detergent formulation that is a combination of detergent components and other optional actives, such as bleaching agents. For ease of use, many detergent formulation users prefer an all-in-one product that incorporates the detergents and optional actives into a single product. Further, many users prefer this product to be a liquid, as compared to a solid or granular product.

One common detergent active is tetraacetylethylenediamine (TAED). TAED functions as a peroxy bleaching activator and a microbial control agent. TAED has been extensively used in solid detergent products. TAED, in liquid detergent formulations which contain in part water, will undergo hydrolysis and lose effectiveness as a detergent active as the TAED reacts to form N,N' diacetylethylenediamine (DAED), which is not effective as a detergent active. As such, TAED, when used without modification, is not ideal as an active for an aqueous detergent formulation. Triacetylethylenediamine (TriAED) is another detergent active. A detergent additive containing one or both of TAED or TriAED that is suitable for use in a liquid detergent formulations that contain water is desired.

SUMMARY OF THE INVENTION

A detergent additive comprising an active, the active comprising one or both of tetraacetylethylenediamine and triacetylethylenediamine; and polyvinyl butyral.

A method of preparing a detergent additive comprising providing a solvent to a reaction mixture; providing polyvinyl butyral to the reaction mixture; providing an active to the reaction mixture, the active comprising one or both of tetraacetylethylenediamine and triacetylethylenediamine; mixing the reaction mixture; and spray-drying the reaction mixture.

DETAILED DESCRIPTION OF THE INVENTION

The present disclosure describes an improved detergent additive. In one aspect, the present disclosure describes a detergent additive comprising an active, for example, tetraacetylethylenediamine (TAED) or tetraacetylethylenediamine (TriAED), and polyvinyl butyral. The improvement of the detergent additive described herein is increased hydrolytic stability for TAED which gives enhanced long-term stability in an aqueous detergent formulation.

Polyvinyl butyral (PVB), or Poly[(2-propyl-1,3-dioxane-4,6-diyl)methylene], is a resin that is the reaction product of polyvinyl alcohol and butyraldehyde and is commercially available from Eastman Chemicals and Kuraray. The molar mass of the polyvinyl butyral is greater than 10 kg/mol. The molar mass of the polyvinyl butyral is less than 250 kg/mol.

The detergent additive is prepared by first dissolving the polyvinyl butyral in a solvent. The polyvinyl butyral is from 1 to 40 weight percent of the reaction mixture, preferably 5 to 20 weight percent of the reaction mixture. The active, for example either TAED or TriAED is then suspended in the reaction mixture. The active content in the reaction mixture is from 0.1 to 30 weight percent, preferably from 5 to 20 weight percent. This reaction mixture is then spray-dried to yield the detergent additive as a dry powder. The detergent additive can be delivered to the washing machine as a dry powder in a powder detergent formulation, or can be formulated as part of a liquid detergent.

The solvent is a polar solvent. Examples of suitable solvents include methanol, acetone, ethyl lactate, and isopropanol.

The spray drying described herein is performed by readily known techniques. The inlet temperature of the spray drying system is selected to be less than the boiling point of the solvent, typically from 80 to 150° C. The air to liquid ratio during the atomization process is optimized based on the desired final particle size of the solid, here, a preferable particle size is from 5 to 50 microns.

The detergent additive is 90 weight percent or less active and 10 weight percent or more polyvinyl butyral. In one instance, the detergent additive is 75 weight percent or less active and 25 weight percent or more polyvinyl butyral. Preferably, the detergent additive is 50 weight percent or less active and 50 weight percent or more polyvinyl butyral.

The solid detergent additive can be optionally be used in solid form. The solid can be optionally grounded or milled into powder form to afford solid active ingredients which have a controlled or delayed releasing profile. The final solids are preferably from 1 to 5 microns in size.

As described herein, the additive encapsulates, or partially encapsulates, the active. As used herein, "encapsulated" refers to the active being bound or retained within the polyvinyl butyral network. The additives described herein are designed to release the active during a triggering event (in the context of the present disclosure, the triggering event might be use in a washing machine). When referring to the active being encapsulated, it refers to the active being retained within the polyvinyl butyral network prior to the triggering event. The additives prepared according to the methods of the present disclosure have an encapsulating efficiency of 30 to 100 percent. Preferably, the additives prepared according to the methods of the present disclosure have an encapsulating efficiency of 60 to 100 percent. More preferably, the additives prepared according to the methods of the present disclosure have an encapsulating efficiency of 90 to 100 percent. As used herein, "encapsulating efficiency" refers to the percentage of prospective actives that are encapsulated in the polyvinyl butyral network of the additive.

The detergent additive described herein has a better long-term stability in aqueous systems than active, such as TAED or TriAED, alone. When the detergent additive is used in a washing machine the active is released from the polyvinyl butyral network, allowing the active to be available in the washing system to perform its peroxy bleach activating function.

The methods described herein are suitable for preparing other types of solid powder systems. For example, the methods described herein can include but are not limited to encapsulating fabric softening agents, detergent actives, bleach actives, fertilizers, micronutrients, pesticides (fungicides, bactericides, insecticides, acaricides, nematocides, and the like), biocides, microbial control agents, polymeric lubricants, fire retardants, pigments, dyes, urea inhibitors, food additives, flavorings, pharmaceutical agents, tissues, antioxidants, cosmetic ingredients (fragrances, perfumes and the like), soil amendments (soil repelling agents, soil release agents and the like), catalysts, diagnostic agents and photoprotective agents (UV blockers and the like).

EXAMPLES

Materials

Mowital® B16H, a Polyvinyl butyral (PVB) polymer, is commercially available from Kuraray Company. Mowital B16H is a reaction product of polyvinyl alcohol and butyraldehyde. It has a glass transition temperature of 63° C., and dynamic viscosity of 14-20 mPa·s for 10% solution in Ethanol. TAED solid was purchased from Sigma Aldrich.

Topas® 5013 is a cyclic olefin copolymer (COC) supplied by Topas company. SMA® EF60 is a low molecular weight styrene maleic anhydride copolymer with an approximate 6:1 mole ratio, from Cray Valley. Both Topas® 5013 and SMA® EF60 are used for a control example.

Encapsulation Procedure

TAED powder was reduced to 1-2 micron by jet milling. The TAED powder was mixed with a PVB methanol solution and the mixture was spray dried to produce a dry powder as described in Table 1.

Spray Drying Procedure

A typical spray drying condition is described below. A fountain two-fluid nozzle atomizer was equipped on a Mobile Minor spray dryer (GEA Process Engineering Inc.). The TAED/polymer solution was fed into the spray dryer using a peristaltic pump (Masterflex L/S). Once the inlet temperature is set, the outlet temperature was then determined by adjusting the feed rate. The resulting powders were collected by the cyclone and vacuum dried at room temperature to removed residual moisture. An inlet temp of 80° C. and an outlet temp of 45° C. was used for the spray dryer. A liquid feed rate setting of 15 mL/min and a nitrogen flow rate to nozzle atomizer at 1 bar 50% flow was used.

An example of this invention and a comparative example are summarized in Table 1. As shown in the table below, both Example 1 and the Comparative Example have the same amount of TAED in the encapsulated TAED powder formulation.

TABLE 1

Process condition and formulation

| ID | TAED | Solvent | Solids content | Spray drying temperature |
|---|---|---|---|---|
| Example #1 | PVB B16H:TAED (66.7:33.3 weight ratio) | Methanol | 15 wt % | Inlet/Oulet = 80/45° C. |
| Comparative Example | COC 5013:SMA EF-60: TAED (55.8:6.2:38 weigh ratio) | Toluene | 10 wt % | Inlet/Oulet = 80/45° C. |

HPLC Analysis for Determining Hydrolysis of TAED to DAED 0.5 grams of TAED without encapsulation and the encapsulated TAED powders listed in Table 1 were added to 20 g allTM Mighty PacTM detergent, and shake for 10 min 1 droplet (ca. 0.1 g) of the mixture was added to 10 g 1:3 Acetonitrile/H2O solvent, and sonicated for 15 minutes to fully dissolve TAED solid. The concentration of DAED of the prepared samples were measured using an Agilent 1100 High-Performance Liquid Chromatography (HPLC) with quaternary pump and diode array detector. The HPLC method conditions are summarized in Table 2.

TABLE 2

HPLC testing conditions

| | |
|---|---|
| System | Agilent 1100 with quaternary pump and diode array detector |
| Column | Eclipse XDB-C18: 4.6 mm × 50 mm × 5 μm |
| Column Temperature | 40° C. |
| Injection Volume | 1 μL sample |
| Flow Rate | 1 mL/min |
| Mobile Phases | A = 18.2 MΩ-cm water, B = acetonitrile |

| Gradient | Time (min) | Composition % A | % B |
|---|---|---|---|
| | 0.0 | 65 | 35 |
| | 3.5 | 0 | 100 |
| | 5.5 | 0 | 100 |

| | |
|---|---|
| Equilibration Time | 2.5 min |
| Total Run Time | ~10 |
| Detection | UV (DAD) @ 216 nm, BW 4 nm, 1 cm cell (TAED) UV (DAD) @ 205 nm, BW 4 nm, 1 cm cell (DAED) |

TABLE 3

HPLC Evaluation Results on DAED concentration

| | Initial Day | Day 1 | Day 2 | Day 7 | Day 20 |
|---|---|---|---|---|---|
| TAED without encapsulation | 0 | 0.0497 | 0.1058 | 0.2643 | 0.4945 |
| Example 1 | 0 | 0.0339 | 0.0688 | 0.1376 | 0.2240 |
| Comparative Example | 0 | 0.0267 | 0.0753 | 0.2357 | 0.4644 |

As shown in Table 3, TAED without any encapsulation and the Comparative Example have a similar DAED concentration at day 20, as the powders are hydrolyzing at a much more rapid rate than Example 1 resulting in increased DAED concentrations. In the case of the encapsulated TAED of this invention (Example 1), the DAED increased much slower, which indicates good encapsulation efficiency using PVB as the polymer barrier. As such, this delayed release profile could extend the shelf life of TAED in aqueous liquid formulations.

The invention claimed is:

1. A detergent additive comprising:

an active, the active comprising one or both of tetraacetylethylenediamine and triacetylethylenediamine;

where the active is encapsulated or partially encapsulated within a network consisting of polyvinyl butyral.

2. The detergent additive of claim 1, wherein the polyvinyl butyral has a molar mass of 10 to 250 kg/mol.

3. The detergent additive of claim 1, wherein the encapsulating efficiency of the active in the additive is from 60 to 100 percent.

* * * * *